US005081907A

United States Patent [19]

Nagel et al.

[11] Patent Number: 5,081,907

[45] Date of Patent: Jan. 21, 1992

[54] HYDROSTATIC DISPLACEMENT ENGINE

[75] Inventors: Gunther Nagel, Steinheim; Franz Arbogast; Peter Peiz, both of Heidenheim, all of Fed. Rep. of Germany

[73] Assignee: J. M. Voith GmbH, Heidenheim, Fed. Rep. of Germany

[21] Appl. No.: 547,679

[22] Filed: Jul. 3, 1990

[30] Foreign Application Priority Data

Jul. 3, 1990 [DE] Fed. Rep. of Germany ..... 3921790

[51] Int. Cl.[5] ..... F01B 1/06

[52] U.S. Cl. ..... 91/497; 91/498; 417/462

[58] Field of Search ..... 91/497, 498; 417/462; 418/31

[56] References Cited

U.S. PATENT DOCUMENTS

| | | | |
|---|---|---|---|
| 2,646,755 | 7/1953 | Joy | 91/497 |
| 3,788,779 | 1/1974 | Carlson | 417/462 |
| 4,265,165 | 5/1981 | Engel et al. | 91/490 |
| 4,503,754 | 5/1985 | Irwin | 91/498 |
| 4,678,412 | 7/1987 | Dantlgraber | 418/31 |
| 4,920,859 | 5/1990 | Smart | 91/497 |

FOREIGN PATENT DOCUMENTS

| | | |
|---|---|---|
| 3545019 | 7/1987 | Fed. Rep. of Germany . |
| 3700573 | 7/1988 | Fed. Rep. of Germany . |

*Primary Examiner*—Richard A. Bertsch
*Assistant Examiner*—Peter Korytnyk
*Attorney, Agent, or Firm*—Baker & Daniels

[57] ABSTRACT

A hydrostatic displacement engine having pistons which slide on the inside of a stroke ring. The eccentricity of the stroke ring, relative to the cylinder block, is variable. The interior of the housing is divided in two areas which are separated from each other preferably by a seal, namely in the area located radially outside the stroke ring and the area located radially within the stroke ring. The inner and outer areas serve as a leakage oil collection space and connects through a leakage oil line with a pressureless liquid container. Emptying in the area situated radially outside the stroke ring is a connection line which is supplied by a pressure supply. A pressure valve maintains the pressure in the outer area at a value of several bars.

10 Claims, 3 Drawing Sheets

HYDROSTATIC DISPLACEMENT ENGINE

BACKGROUND OF THE INVENTION

The invention generally relates to a hydrostatic displacement engines such as radial piston engines (pump or motor) or vane engines (pump or motor). More particularly, the invention pertains to a hydrostatic displacement engine in which a rotating cylinder block contains several radially shiftable displacement elements that slide on a stroke ring.

Prior engines of this type have been described, e.g., in the following documents:

German patent disclosure 35 45 019,

German patent disclosure 37 00 573.

The radial piston pump known from the German patent disclosure 35 45 019 has a rotatable cylinder block which is mounted on a stationary control journal. This journal is situated in a housing whose interior is sealed by a housing cover. Contained in the cylinder block are several radially movable pistons which, by way of a piston shoe each bear on the inside of a stroke ring. Although not immediately evident from the German patent disclosure, the stroke ring is movable transverse to the axis of rotation of the cylinder block in order to change the stroke of the piston. All areas of the housing interior, i.e., those areas situated within and outside the stroke ring, are connected with one another and connected with a low-pressure area (for instance in the form of a liquid container) by means of a leakage oil outlet.

Radial piston engines of this design (working either as a pump or as a motor) and the vane engines operating according to a similar principle have been proven in practice. A problem with these displacement engines, however, is the noise which is occasionally experienced in their operation, and in particular the frequently observed change of noise. The noise intensity assumes elevated levels especially when the stroke ring is contained in an intermediate position, i.e., when the stroke ring bears on neither of its two limit stops.

The problem underlying the invention is to introduce measures by which the operationally caused noise in the aforementioned hydrostatic displacement engines will be reduced, especially in an intermediate position of the stroke ring.

SUMMARY OF THE INVENTION

This problem is solved by the present invention. By adjusting a specific liquid pressure in the housing interior, radially outside the stroke ring, wherein the pressure ranges above atmospheric pressure, the noise propagation of a displacement engine may be considerably reduced. This applies primarily to the operating condition in which the stroke ring is contained in an intermediate position and in which an especially intensive noise has been experienced. Specifically, it is possible to keep the remaining noise intensity more uniform than heretofore.

There are several options for establishing the desired seal between the area of the housing interior that is situated radially outside the stroke ring and the area situated radially within the stroke ring. According to one option, a ring-shaped sealing element is inserted on one of the two end faces of the stroke ring, between the stroke ring and the adjacent housing wall. This sealing element likewise forces the stroke ring with its other end face down on the adjacent housing wall, thus establishing a seal. This design has the advantage in that relatively coarse manufacturing tolerances can be permitted for the width of the stroke ring and for the spacing between the respective housing walls. Alternatively, the special sealing elements may be omitted. In this case, the end faces of the stroke ring bear directly on the adjacent housing walls. However, in this case, it is necessary to ensure that the stroke ring will continue to be movable, transverse to the axis of rotation of the cylinder block. Consequently, the components must be manufactured with great accuracy.

According to one embodiment of the invention, a medium liquid pressure is located in the area of the housing interior that is situated radially outside the stroke ring. This pressure does not range halfway between the pressures that prevail in the high-pressure and low-pressure channels; instead, the pressure ranges several bars above atmospheric pressure or above the pressure that prevails in the area of the housing interior that is located radially within the stroke ring.

There are now various possibilities for building up the "halfway" pressure in the area of the housing interior that is situated radially outside the stroke ring. One possibility is that leakage fluid flows without specific additional measures from the high-pressure area into the radially outer area of the housing interior, thus creating the "halfway" pressure. In order to limit this "halfway" pressure to 2–4 bars, for example, the radially outer area can be connected with the radially inner area by way of a hydraulic resistance, e.g. a choke.

To keep the "halfway" pressure safely at the desired value, however, it is preferable to allow the fluid to flow deliberately from a pressure supply into the radially outer area. It is advantageous to connect the two areas that lie radially outside and radially inside the stroke ring with one another by way of a pressure valve. All embodiments of the invention presuppose that the area situated inside the stroke ring (as so far the entire housing interior) is connected to a low-pressure area, for instance an external non-pressurized liquid container or to the low-pressure channel contained in the housing.

As an external pressure supply for the radially outer area, the leakage oil space of a control unit pertaining to the displacement engine may preferably be used. This control unit, which may be a pressure controller, is directly attached to the housing of the displacement engine for the adjustment of the individually desired eccentricity (spacing between stroke ring axis and cylinder block axis of rotation). In other words, the servo oil accruing in the controller and/or the leakage oil is passed into the area of the housing interior that is situated radially outside the stroke ring. Thus, the "halfway" pressure will build up to the level of, e.g., 2 to 4 bars, depending on the setting of the pressure valve.

However, the area of the housing interior that is located radially outside the stroke ring can also be connected to any other external pressure supply. Another possibility is the use of the low-pressure channel contained in the housing as a pressure supply. This is possible whenever the displacement engine is part of a closed hydraulic system where a "halfway" pressure prevails in the low-pressure channel.

Other options are available if at least approximately atmospheric pressure prevails in the low-pressure channel. In this case, the area of the housing interior that is situated radially inside the stroke ring is connected directly with the suction channel. Or, only the outlet of the pressure valve is connected with the suction channel.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
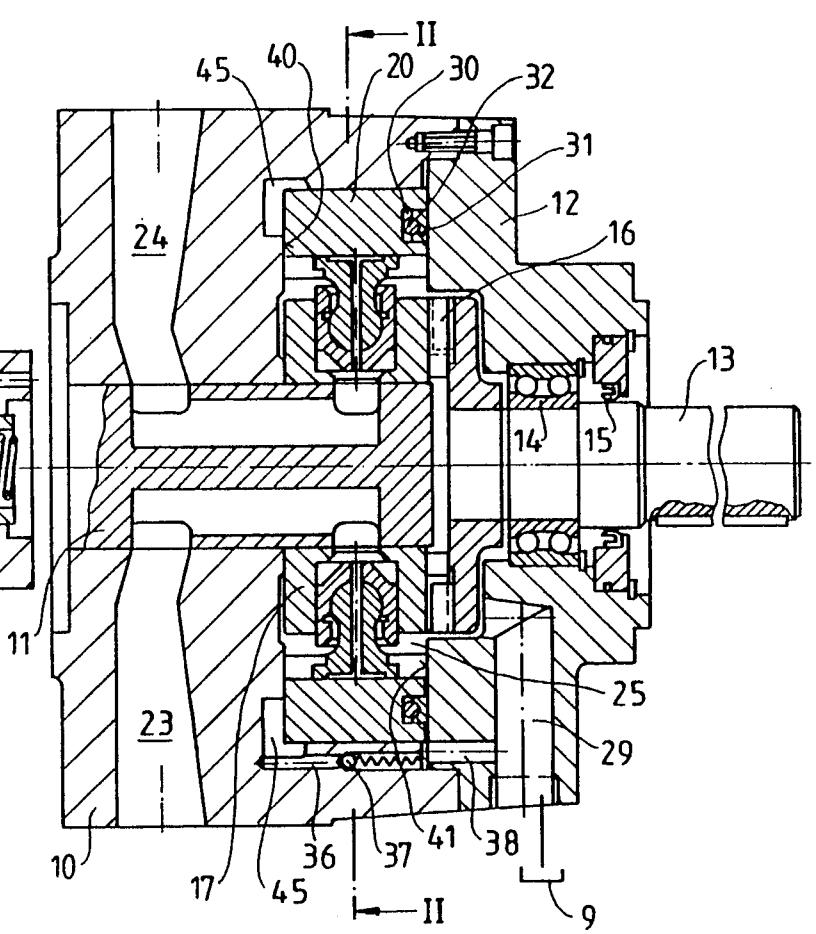
FIG. 1 is a longitudinal sectional view of a radial piston engine.

The essential and already known components of the illustrated radial piston engine (for instance radial piston pump) are the following: a housing 10, in which a fixed control journal 11 is inserted, is sealed by a housing cover 12. A drive shaft 13 including an antifriction bearing 14 and a drive shaft seal 15 is mounted in housing cover 12. The drive shaft connects through a clutch 16 with the cylinder block 17, which is rotatably mounted on control journal 11. Contained in cylinder block 17, in a star-shaped arrangement, are seven pistons 18. Other numbers of pistons are possible. Each of these pistons 18 is hinged to a piston shoe 19. The stroke ring 20 assumes an eccentric position in housing 10 relative to the control journal 11. Piston shoes 19 slide along the inner cylinder surface of stroke ring 20. The magnitude of the eccentricity e between control journal 11 and stroke ring 20 is variable by shifting stroke ring 20 with the aid of servo pistons 21 and 22. The working fluid circuit comprises a low-pressure channel 23 and a high-pressure channel 24 that extend through housing 10 and control journal 11. A control unit for adjustment of the liquid pressure acting on servo pistons 21 and 22 has been omitted in FIG. 2; however, refer to FIG. 3.

The area 25 of the housing interior situated radially inside stroke ring 20, in which the movable parts 13, 14 and 16–19 rotate, connects by way of a leakage oil channel 29 with a low-pressure area, e.g. with a pressureless oil container 9 (illustrated only symbolically). Thus, in this radially inner area 25, there prevails a pressure that amounts to about between zero and 1 bar.

According to one aspect of the invention, area 26 of the housing interior situated radially outside stroke ring 20 is separated from the remaining housing interior, i.e., from the radially inner area 25. To that end, according to FIGS. 1 and 2, one of the end faces of stroke ring 20 is provided with an annular groove 30 in which an axially movable ring seal 31 is contained. Stroke ring 20 and ring seal 31 are spread apart in an axial direction with the aid of at least one elastic element 32, (e.g. an O-ring). As a result, stroke ring 20 continuously bears in sealing fashion with its one end face on surface 40 of housing 10. On the opposite end face of stroke ring 20, ring seal 31 constantly bears in sealing fashion on surface 41 of housing cover 12. It is essential that in the radially outer area 26 of the interior, a "halfway" pressure of about 2 to 4 bars builds up. This can be brought about, e.g., in that leakage fluid penetrates from a pressure space 54, which is later discussed (refer to FIG. 3), along the servo piston 21 into outer area 26. Preferably, however, outer area 26 is connected with any pressure supply through channel 33 so that the buildup of the "halfway" pressure in area 26 will take place as quickly as possible.

A certain pressure difference is suitably maintained at all times between the pressure that prevails in radially outer area 26 and the pressure in radially inner area 25. To maintain this pressure difference of, e.g., 2 to 4 bars, area 26 communicates through bores 36 and 38 with leakage oil channel 29. Additionally, as illustrated schematically in FIG. 1, bore 36 accommodates a check valve 37 which opens only when the pressure difference exceeds the desired value. Instead of check valve 37, any other suitable pressure valve may be provided, e.g. a pressure relief valve.

Housing 10 possesses on its inside, in known fashion, two guide surfaces 42 for guidance of stroke ring 20. These guide surfaces divide the radially outer area 26 of the housing interior in two chambers which are connected with each other through channels 45. In the illustrated example, connecting channels 45 have been machined into housing 10. However, similar connecting channels could be provided also in stroke ring 20.

Figure 6:
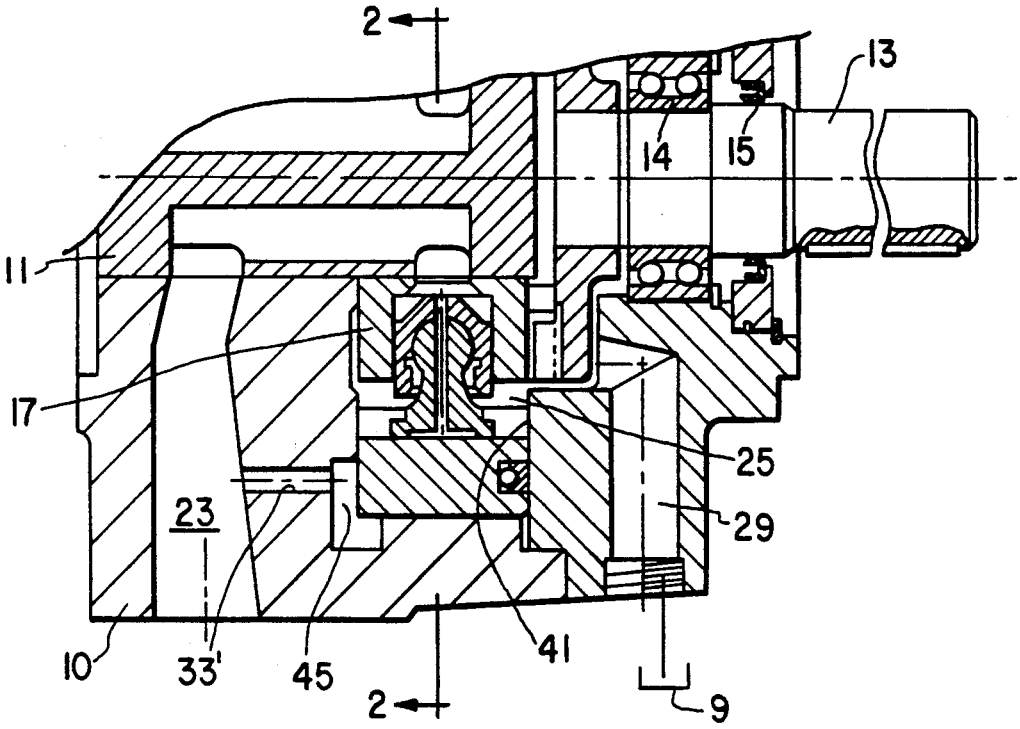

In FIG. 6, a connecting channel 33' from low pressure channel 23 to one of the connecting channels 45 is additionally illustrated by dash-dot lines. This arrangement is an alternative to the aforementioned channel 33 of FIG. 2. The arrangement with connecting channel 33' is applicable whenever in low-pressure channel 23 there exists a "halfway" liquid pressure which then propagates into area 26 of the housing interior that is situated radially outside the stroke 20.

Figure 2:
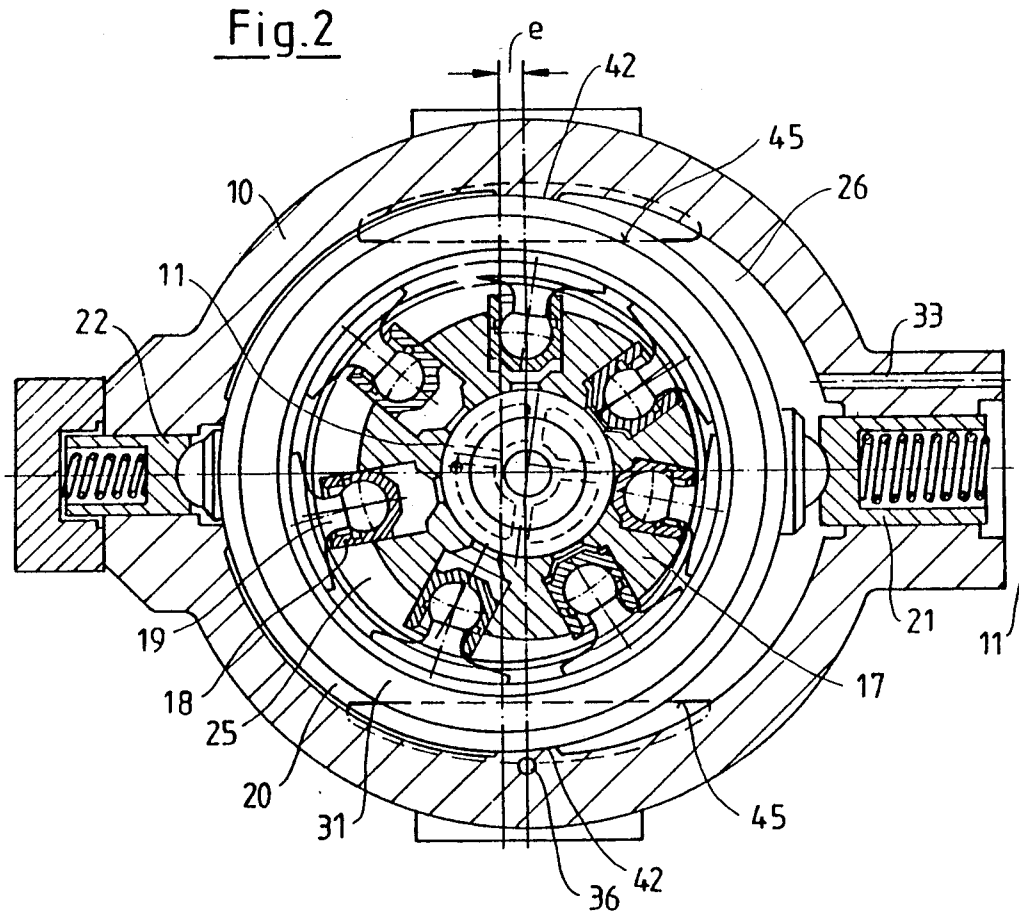
FIG. 2 a cross sectional view along line II—II of FIG. 1.
Figure 3:
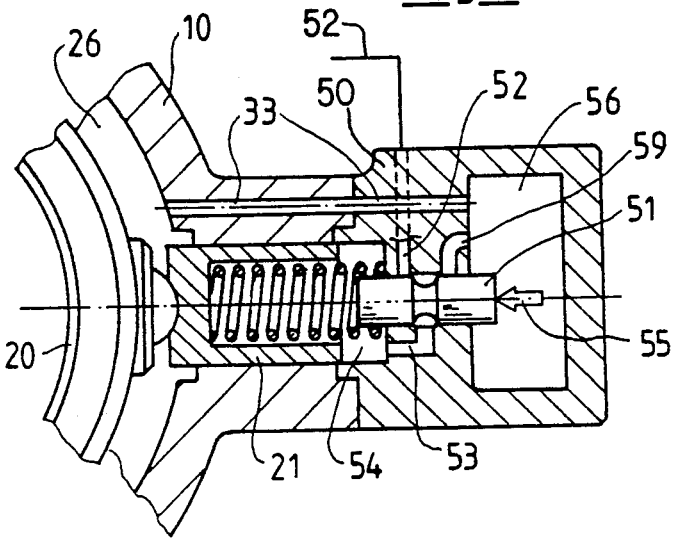
FIGS. 3–6, show alternative embodiments of the engine of FIGS. 1 and 2.

FIG. 3 shows a supplement to FIG. 2. In FIG. 3, part of housing 10 is shown, in addition to part of stroke ring 20 and servo piston 21. A control unit 50, which is schematically illustrated, is attached to housing 10. A movable valve body 51 of a pressure control valve is contained in this control unit. Valve body 51 connects a channel 53, which extends to pressure space 54 of servo piston 21 with either a channel 52 that is connected to high-pressure channel 24 (FIG. 1) or with a relief channel 59 that empties into the interior 56 of the control unit. This controls the servo force of servo piston 21 acting on stroke ring 20, and thus the magnitude of eccentricity e (FIG. 2). A servo force acting, for instance mechanically, on valve body 51 is symbolically illustrated by arrow 55. The servo fluid and/or leakage fluid accumulates in interior 56 up to a certain pressure, whereupon the fluid propagates through channel 33 and into the radially outer area 26 of housing 10, where it is limited by pressure valve 37 (FIG. 1).

Figure 4:
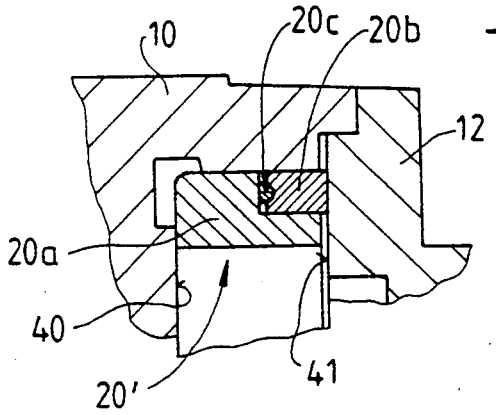

FIG. 4 shows an alternative embodiment to FIG. 1. Illustrated are parts of housing 10 and housing cover 12. The stroke ring is now marked 20'; it is divided into a principal partial ring **20*a* and an auxiliary partial ring 20*b*. Ring 20*b* forms a radially outer part of the entire stroke ring 20' and is axially movable on principal partial ring 20*a*. A spring element, for instance O-ring 20*c*, is inserted under prestress between the two partial rings. The two partial rings 20*a* and 20*b* are thereby spread apart in axial direction so that the two partial rings will bear in sealing fashion on adjacent housing faces 40 or 41**.

Figure 5:
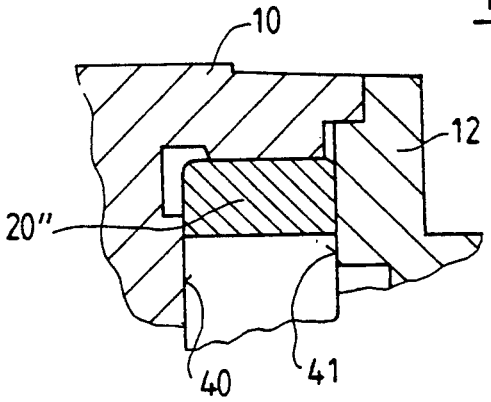

FIG. 5 shows another alternative embodiment to FIGS. 1 and 4. Here, stroke ring 20'' is now designed as a one-piece part without a specific sealing element. Its two end faces bear in sealing fashion on adjacent housing walls 40 and 41.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydrostatic displacement engine, comprising:

a housing including a housing interior;

a stroke ring located within said housing interior and having a first axis;

a rotating cylinder block having a plurality of cylinders therein and a plurality of radially reciprocable pistons in said cylinders that slide on said stroke ring and displace fluid in said cylinders;

a working fluid comprising said cylinders, and inlet channel, an outlet channel and passages connecting the inlet and outlet channels to said cylinders;

means for shifting said stroke ring transverse to the axis of rotation of said cylinder block, so that the spacing between said first axis and the axis of rotation of said cylinder block is variable, said means for shifting comprising a control means mounted directly on said housing and having a pressurized fluid actuated member that positively engages said stroke ring to selectively shift said stroke ring transverse to the axis of rotation;

said housing interior having a radially outer area that is situated generally radially outside and contiguous to said stroke ring, said stroke ring being sealed relative to a radially inner area of said housing interior that is situated generally radially within said stroke ring, the fluid that pressurizes said fluid actuated member also communicating with the radially outer area of the housing interior to cause a pressure above atmospheric pressure to build up in said radially outer area, the radially inner area being connected with a low pressure area.

2. The displacement engine according to claim 1, wherein said radially outer area connects through a pressure valve with a low-pressure area.

3. The displacement engine according to claim 1 wherein said stroke ring includes on one of its two end faces an annular groove into which a sealing element is inserted, the sealing element bearing on an adjacent housing wall.

4. The displacement engine according to claim 1, wherein:

said stroke ring comprises a principal partial ring and an auxiliary partial ring in said radially outer area;

said two partial rings are in sealing fashion shiftable relative to each other in the axial direction; and at least one spring element is inserted under prestress, between said partial rings.

5. The displacement engine according to claim 1, wherein said stroke ring bears with its two end faces in sealing fashion on the adjacent housing walls.

6. A hydrostatic displacement engine, comprising:

a housing including a housing interior;

a stroke ring located within said housing interior and having a first axis;

a rotating cylinder block containing a plurality of radially shiftable displacement elements that slide on said stroke ring;

means for shifting said stroke ring transverse to the axis of rotation of said cylinder block, so that the spacing between said first axis and the axis of rotation of said cylinder block is variable;

said housing having a radially outer area that is situated generally radially outside said stroke ring being sealed relative to a radially inner area of said housing interior that is situated generally radially within said stroke ring, whereby a pressure above atmospheric pressure will build up in said radially outer area;

said radially outer area connecting through a pressure valve with a low pressure area.

7. The displacement engine according to claim 6, wherein said pressure valve is a check valve that limits the pressure in said outer area.

8. A hydrostatic displacement engine, comprising:

a housing including a housing interior;

a stroke ring located within said housing interior and having a first axis;

a rotating cylinder block containing a plurality of radially shiftable displacement elements that slide on said stroke ring;

means for shifting said stroke ring transverse to the axis of rotation of said cylinder block, so that the spacing between said first axis and the axis of rotation of said cylinder block is variable;

said housing having a radially outer area that is situated generally radially outside said stroke ring being sealed relative to a radially inner area of said housing interior that is situated generally radially within said stroke ring, whereby a pressure above atmospheric pressure will build up in said radially outer area;

said stroke ring having two end faces and including on one of its end faces an annular groove into which a sealing element is inserted, the sealing element bearing on an adjacent housing wall.

9. The displacement engine according to claim 8, wherein said sealing element comprises a metal ring bearing on said housing wall and at least one spring element which under axial prestress is inserted between said stroke ring and said metallic ring seal.

10. A hydrostatic displacement engine, comprising:

a housing including a housing interior;

a stroke ring located within said housing interior and having a first axis;

a rotating cylinder block containing a plurality of radially shiftable displacement elements that slide on said stroke ring;

means for shifting said stroke ring transverse to the axis of rotation of said cylinder block, so that the spacing between said first axis and the axis of rotation of said cylinder block is variable;

said housing having a radially outer area that is situated generally radially outside said stroke ring being sealed relative to a radially inner area of said housing interior that is situated generally radially within said stroke ring, whereby a pressure above atmospheric pressure will build up in said radially outer area;

said stroke ring comprising a principal partial ring and an auxiliary partial ring in said radially outer area, said two partial rings being in sealing fashion shiftable relative to each other in the axial direction, at least one spring element being inserted under prestress between said partial rings.

* * * * *

UNITED STATES PATENT AND TRADEMARK OFFICE

CERTIFICATE OF CORRECTION

PATENT NO. : 5,081,907

DATED : January 21, 1992

INVENTOR(S) : Gunther Nagel, Franz Arbogast and Peter Peiz

It is certified that error appears in the above-identified patent and that said Letters Patent is hereby corrected as shown below:

On the Title page, item [57]

In the Abstract, line 6 delete "in"

Claim 1, column 5, line 26, after "fluid" insert --circuit--
Claim 1, column 5, line 26, delete "and" and insert --an--

Signed and Sealed this

Twenty-fifth Day of May, 1993

*Attest:*

Michael K. Kirk

MICHAEL K. KIRK

*Attesting Officer*

*Acting Commissioner of Patents and Trademarks*